US009765473B2

(12) United States Patent
Holm

(10) Patent No.: US 9,765,473 B2
(45) Date of Patent: Sep. 19, 2017

(54) APPLIANCE FOR TREATING A TEXTILE AND METHOD FOR TREATING A TEXTILE

(71) Applicant: AKTIEBOLAGET ELECTROLUX, Stockholm (SE)

(72) Inventor: Henrik Holm, Stockholm (SE)

(73) Assignee: Aktiebolaget Electrolux (SE)

( * ) Notice: Subject to any disclaimer, the term of this patent is extended or adjusted under 35 U.S.C. 154(b) by 0 days.

(21) Appl. No.: 14/398,008

(22) PCT Filed: Apr. 26, 2013

(86) PCT No.: PCT/EP2013/058773

§ 371 (c)(1),
(2) Date: Oct. 30, 2014

(87) PCT Pub. No.: WO2013/164275

PCT Pub. Date: Nov. 7, 2013

(65) Prior Publication Data

US 2015/0082839 A1 Mar. 26, 2015

(30) Foreign Application Priority Data

May 3, 2012 (SE) ..... 1200260-6

(51) Int. Cl.
*D06F 73/00* (2006.01)
*D06F 75/30* (2006.01)

(52) U.S. Cl.
CPC ..... *D06F 73/00* (2013.01); *D06F 75/30* (2013.01)

(58) Field of Classification Search
None
See application file for complete search history.

(56) References Cited

U.S. PATENT DOCUMENTS

| | | | | |
|---|---|---|---|---|
| 3,620,055 | A | 11/1971 | Blachly | |
| 7,908,776 | B2 | 3/2011 | Ng et al. | |
| 9,157,180 | B2 | 10/2015 | Hu | |
| 2013/0219758 | A1 * | 8/2013 | Jiang | D06F 73/00 38/144 |

FOREIGN PATENT DOCUMENTS

| | | | |
|---|---|---|---|
| CN | 2514021 | | 10/2002 |
| CN | 2514021 | Y * | 10/2002 |
| CN | 102199866 | A | 9/2011 |
| DE | 202004014412 | | 12/2004 |

(Continued)

OTHER PUBLICATIONS

International Search Report for PCT/EP2013/058773 dated Oct. 22, 2013.

(Continued)

*Primary Examiner* — Michael Barr
*Assistant Examiner* — Jason Riggleman
(74) *Attorney, Agent, or Firm* — RatnerPrestia

(57) ABSTRACT

An appliance for treating a textile. The appliance has a textile contact surface adapted to interact with the textile to be treated, an airflow generating device, and a first outlet connected to the airflow generating device. The first outlet is arranged adjacent to the textile contact surface. The first outlet is arranged to direct an airflow through the first outlet in an airflow direction that is directed away from a normal of the textile contact surface.

17 Claims, 8 Drawing Sheets

(56) References Cited

FOREIGN PATENT DOCUMENTS

| | | | |
|---|---|---|---|
| EP | 1837435 | | 9/2007 |
| FR | 2764912 | | 12/1998 |
| GB | 2484689 A | * | 10/2010 |
| GB | 2484689 | | 4/2012 |
| RU | 2417278 C2 | | 4/2011 |

OTHER PUBLICATIONS

Chinese Office Action dated Feb. 2, 2016 for Chinese Application No. 201380023026.1.
Australian Examination Report for Australian Application No. 2013255958, dated Jan. 3, 2017, 3 pages.
European Communication for European Application No. 13 719 102.9, dated Apr. 6, 2017, 5 pages.
Russian Office Action for Russian Application No. 2014143852, dated Mar. 29, 2017, including English translation, 8 pages.

* cited by examiner

APPLIANCE FOR TREATING A TEXTILE AND METHOD FOR TREATING A TEXTILE

This application is a U.S. National Phase application of PCT International Application No. PCT/EP2013/058773, filed Apr. 26, 2013, and claims the benefit of Swedish Application No. SE 1200260-6, filed May 3, 2012, both of which are incorporated herein by reference.

TECHNICAL FIELD

The present invention relates to an appliance for treating a textile, and a method of treating a textile.

BACKGROUND

Textiles, such as garments, may be wrinkled. Wrinkles may be removed by ironing with an iron. A different approach for removing wrinkles from textiles is by means of a steamer. A steamer may be used for touching up garments prior to use of the garments. In a steamer, steam is produced and the steam is emitted from the steamer onto a textile. A user directs the steamer, or a part thereof, along a textile to be treated.

When ironing, steam may be utilized to improve removal of wrinkles. For instance FR 2764912 discloses an iron comprising an electric heating element and a system for generating a flow of hot air into which atomized water is injected. Water droplets evaporate and form steam before they reach a textile being ironed. However, ironing is based on the use of a heated sole plate being pressed against a textile placed on an ironing board, which is a different method of removing wrinkles from a textile than steaming by means of a steamer.

U.S. Pat. No. 3,620,055 discloses a hand-held portable steamer comprising a head portion with a handle, a sole plate, with steam ports, forming one wall of the head portion. A pump has a manual operating button extending from the handle. Water is transferred from a reservoir in the head portion to an electric flash boiler from which steam passes to the ports.

DE 202004014412 U1 discloses a steam supply unit for care of textiles, comprising a nozzle carrier formed as a pipe with second outlet nozzles, which are arranged side by side in the longitudinal direction of the pipe.

In the field of textile care, there is a desire to provide alternative appliances and/or methods for treating a textile, e.g. in order to remove wrinkles from the textile.

SUMMARY

An object of the present invention relates to an appliance for treating a textile which provides at least a reduction of wrinkles in the textile.

According to an aspect of the invention, the object is achieved by an appliance for treating a textile. The appliance comprises a textile contact surface adapted to interact with the textile to be treated. The appliance comprises an airflow generating device and a first outlet connected to the airflow generating device. The first outlet is arranged adjacent to the textile contact surface, and the first outlet is arranged to direct an airflow through the first outlet in an airflow direction. The airflow direction is directed away from a normal of the textile contact surface.

Since the first outlet is arranged to direct an airflow in a direction away from a normal of the textile contact surface, in use, an airflow is directed along a textile to be treated to engage the textile to abut against, or at least be positioned adjacent to, the textile contact surface. Thus, the textile is stretched by the airflow engaging with the textile. The stretching of the textile brings about a drawing out of the wrinkles, which improves a wrinkle removing operation. As a result, the above mentioned object is achieved.

The appliance may be used for stretching of textiles such as garments, e.g. for reduction or removal of wrinkles. The appliance may be used for hanging garments. The appliance may be a domestic appliance, a public appliance, or a commercially used appliance. The airflow generating device is arranged to produce an airflow. The airflow exits the appliance via the first outlet. The airflow generating device may be any suitable device such as e.g., a fan or a compressor. A textile to be treated may be brought to abut against, and even adhere to, the textile contact surface of the appliance by means of the airflow. The textile to be treated may be wet, or damp e.g. from a washing operation, a wetting operation, or a steaming operation. Thus, an improved removal of wrinkles from the textile to be treated by stretching the textile to be treated by means of the airflow may be achieved compared to if the textile to be treated is dry. The airflow may also dry such a wet or damp textile to be treated.

According to embodiments, the appliance may comprise a steam producing unit for producing steam from water, and a directing arrangement for directing steam produced in the steam producing unit towards the textile to be treated. The directing arrangement may be connected to the steam producing unit. In this manner the steam may be distributed to the textile to be treated and utilized to improve removal of wrinkles from the textile to be treated.

In use, steam thus, may be emitted, to, into, or onto, the textile to be treated. The stretching of the textile to be treated by means of the airflow from the first outlet in connection with subjecting the textile to be treated to steam brings about a drawing out of the wrinkles, which improves a wrinkle removing operation.

According to embodiments, the directing arrangement may comprise a second outlet. In this manner steam produced in the steam producing unit may be emitted towards a textile to be treated from the second outlet.

According to embodiments, the directing arrangement may comprise an enclosure to be filled with steam from the steam producing unit, inside which enclosure the textile to be treated may be place during treatment.

According to embodiments, the second outlet may be arranged in connection with the textile contact surface. In this manner steam may be emitted from the first outlet into or onto the textile in, or, at the textile contact surface, i.e. in a part of the appliance, in which stretching of a textile to be treated by means of the airflow takes place.

The second outlet may comprise a number of openings provided in the textile contact surface or next to the textile contact surface. The second outlet may comprise one or more openings extending along the textile contact surface, in the textile contact surface, or next to the textile contact surface. The steam producing unit may be any suitable steam producing unit such as e.g., a boiler with an electrical heating element or a flash boiler. The steam producing unit may be a separate unit connected to the by means of a conduit to the remainder of the appliance. Alternatively, the steam producing unit may be arranged in an entity together with the air flow generating device, and/or it may be arranged in close proximity of the second outlet.

According to embodiments, the airflow direction may form an angle of 70-120 degrees to the normal of the textile contact surface. In this manner it may be ensured that the airflow engages with a textile to be treated.

According to embodiments, the airflow direction may form an angle of 85-105 degrees to the normal of the textile contact surface. In this manner it may be ensured that the airflow engages thoroughly with a textile to be treated and that the textile will abut against the textile contact surface.

The term "airflow direction" refers to one direction. Suitably, the first outlet thus, may be formed to provide a substantially parallel airflow from the first outlet. However, the first outlet may be formed to provide a small dispersion angle of an airflow from the first outlet. In the latter case, the above mentioned airflow direction refers to a centre line of the dispersion angle.

According to embodiments, the first outlet may comprise a first passage and a second passage. The textile contact surface may be arranged between the first passage and the second passage. In these embodiments the airflow is arranged to be directed in at least two different directions, suitably opposite directions, away from the textile contact surface. The airflow being directed in at least two different directions engages with a textile to be treated and exerts a force to the textile, drawing the textile towards, and to abut against, the textile contact surface. Thus, the textile is subjected to stretching over the textile contact surface, where steam may be emitted towards the textile. A good removal of wrinkles may thus be achieved. A user simply has to move the textile contact surface together with the first outlet along the textile to portions thereof, where wrinkles are to be removed. The user does not have to provide any stretching of the textile. In particular for lighter textiles used in garments such as shirts and blouses, the stretching of the textile by means of the appliance itself may prove useful.

According to embodiments, the first outlet may extend around the textile contact surface. In this manner a textile to be treated will be thoroughly engaged by the airflow and provide a sure abutment of the textile against the textile contact surface. Such a first outlet extending around the textile contact surface may comprise two or more passages, the passages being connected to the airflow generating device.

According to embodiments, a directing surface may extend in a direction from the textile contact surface adjacent to the first outlet. In this manner the airflow may be directed along a textile to be treated downstream of the first outlet. The textile thus, may abut well against the textile contact surface.

According to embodiments, the textile contact surface, the first outlet, and the second outlet may be arranged in a manually maneuverable handle. In this manner a user may hold the handle and direct it along a textile to be treated.

According to embodiments, a cross section of the first outlet may be adjustable in size. In this manner the airflow may be controlled and thus, an abutment force of a textile against the textile contact surface may be controlled.

According to embodiments, the first outlet may comprise at least one flexible edge portion. In this manner the flexible edge portion may automatically adjust a size of the first outlet and automatically adjust the airflow. The flexible edge portion may be biased toward a position in which the first outlet is closed, or substantially closed, or has a reduced cross section. The airflow will open and/or adjust the cross section of the first outlet. Thus, an air velocity of the airflow may be maintained within a predetermined range substantially independently of the volume of air in the airflow.

According to embodiments, the first outlet may be separate from the second outlet.

According to embodiments, a second conduit may extend from the steam producing unit to the second outlet and a first conduit may extend from the airflow generating device to the first outlet. In this manner steam may be directed from the steam producing unit through the second conduit to the second outlet and an airflow may be directed from the airflow generating device through the first conduit to the first outlet.

A further object of the present invention is to provide an improved method for removal of wrinkles from a textile.

According to an aspect of the invention, the object is achieved by a method of treating a textile, the method comprising: producing an airflow, and directing the airflow through a first outlet arranged adjacent to the textile contact surface in an airflow direction directed away from a normal of a textile contact surface, for making the textile interact with the textile contact surface.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Figure 1A:
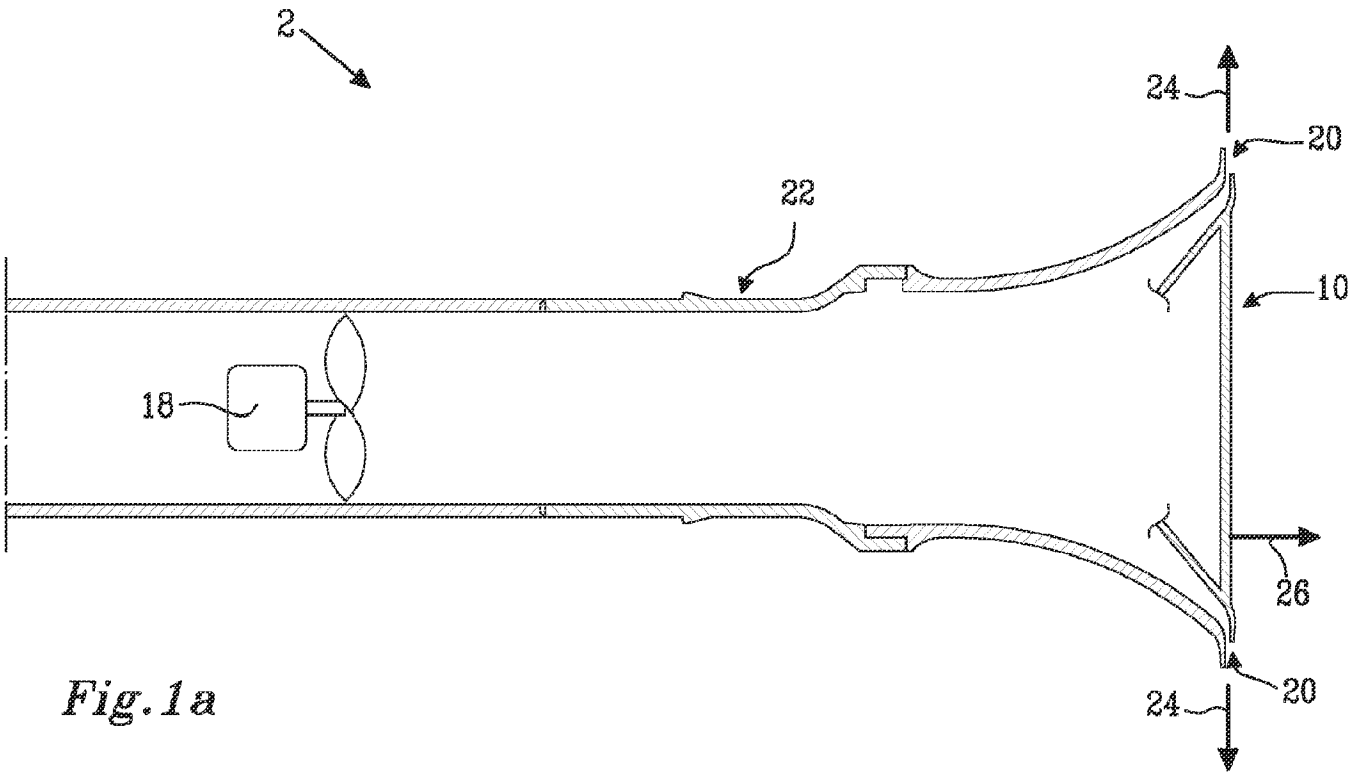
FIGS. 1*a* and 1*b* illustrate schematically cross sections of appliances according to embodiments.

FIG. 1*a* illustrates schematically a cross section of an appliance 2 according to embodiments. The appliance 2 may be used for treating a textile, such as a garment, in particular for stretching the textile, e.g. to remove wrinkles from the textile. The appliance 2 comprises a textile contact surface 10. An airflow generating device 18 is connected to a first outlet 20 via a first conduit 22. Accordingly, the first conduit 22 extends from the airflow generating device 18 to the first outlet 20. The first outlet 20 is arranged adjacent to the textile contact surface 10. The first outlet 20 is arranged to direct an airflow from the airflow generating device 18 in an airflow direction, indicated by arrows 24. The airflow direction 24 is directed away from a normal 26 of the textile contact surface 10.

Figure 1B:
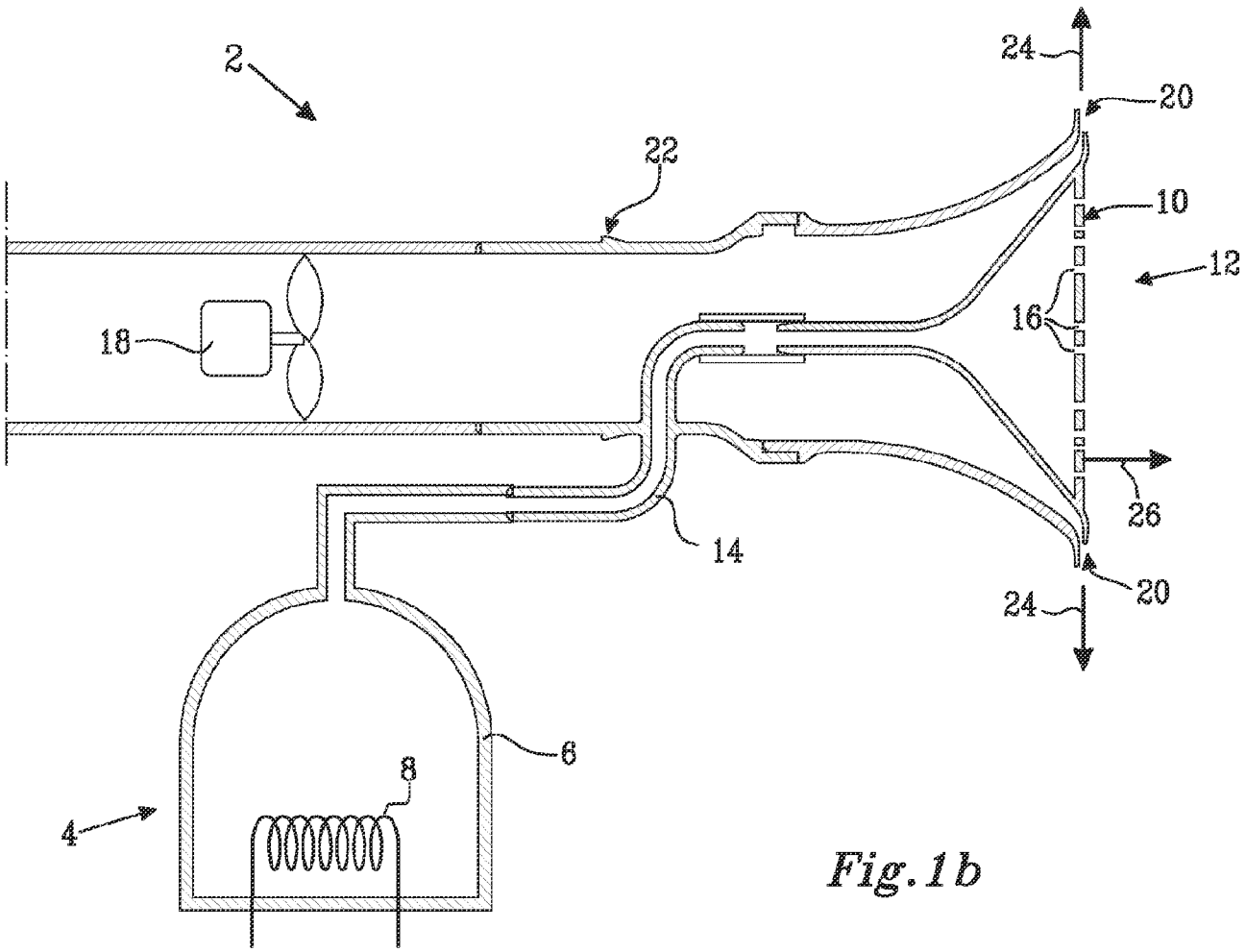

FIG. 1*b* illustrates schematically a cross section of an appliance 2 according to embodiments. The appliance 2 may be used for treating a textile, such as a garment, in particular to remove wrinkles from the textile. The appliance 2 comprises a steam producing unit 4 for producing steam from water. The steam producing unit 4 comprises a container 6 and a heating element 8 for heating water in the container 6. The appliance 2 further comprises a textile contact surface 10, and a directing arrangement comprising a second outlet 12 connected to the steam producing unit 4 via a second conduit 14. Accordingly, the second conduit 14 extends from the steam producing unit 4 to the second outlet 12. The second outlet 12 is arranged in connection with the textile contact surface 10 and has a number of openings 16 arranged in the textile contact surface 10. Typically 15 grams/minute steam may be produced by the steam producing unit 4 and emitted from the second outlet 12.

An airflow generating device 18 is connected to a first outlet 20 via a first conduit 22. Accordingly, the first conduit 22 extends from the airflow generating device 18 to the first outlet 20. The first outlet 20 is arranged adjacent to the textile contact surface 10. The first outlet 20 is arranged to direct an airflow from the airflow generating device 18 in an airflow direction, indicated by arrows 24. The airflow direction 24 is directed away from a normal 26 of the textile contact surface 10. The second outlet 12 is separate from the first outlet 20.

The first outlet 20 may have an opening width of 0.5-3 mm between edges of the first outlet 20. A typical width may be 1 mm. An airflow generated by the airflow generating device 18 may be within 15-40 liters/minute. A typical value may be 25 liters/minute. An air pressure generated by the airflow generating device 18 may be between 3-8 kPa. A typical pressure may be 6 kPa. A velocity of the airflow though the first outlet 20 may be between 50-100 meters/second. A typical velocity may be 78 meters/second.

Figure 2:
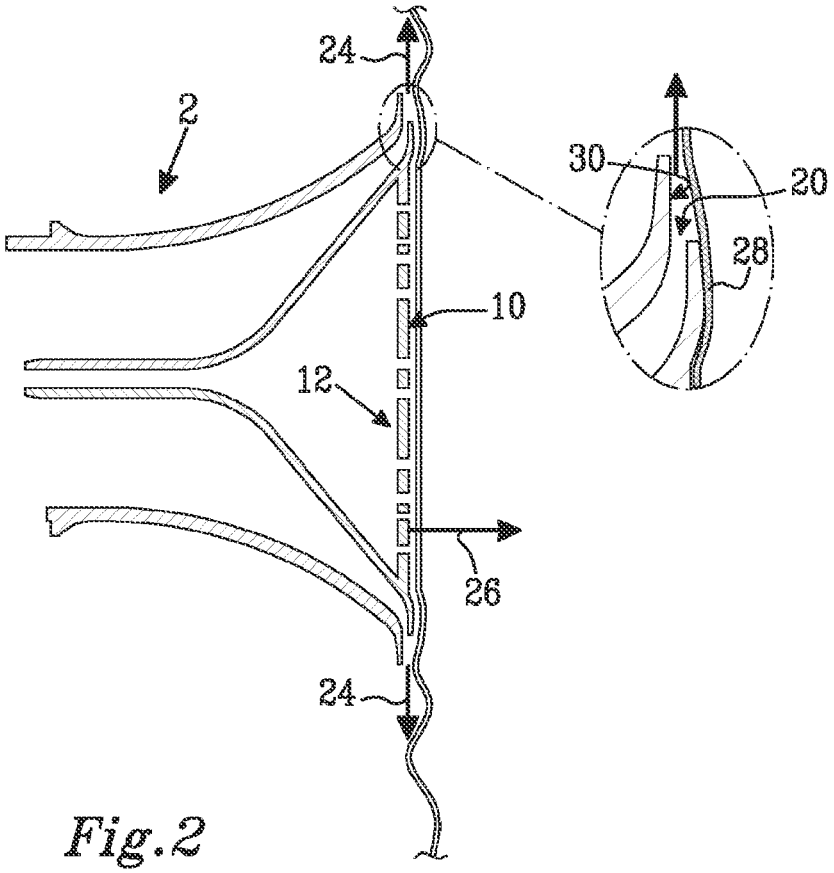
FIG. 2 illustrates a cross section of a portion of an appliance according to embodiments.

FIG. 2 illustrates a cross section of a portion of an appliance 2 according to embodiments. The appliance 2 is illustrated in use, as a textile 28 is being treated by means of the appliance 2. Steam produced in a steam producing unit is emitted form a second outlet 12 arranged in connection with a textile contact surface 10. An airflow produced in an airflow generating device is directed through a first outlet 20 in an airflow direction 24 away from a normal 26 of the textile contact surface 10. The airflow is directed along the textile 28 to be treated. Thus, the airflow from the first outlet 20 draws air between the textile 28 and the textile contact surface 10 with it in the airflow direction 24 and draws the textile 28 towards the textile contact surface 10. Put differently, the airflow engages the textile 28 to abut against the textile contact surface 10. Simultaneously, the textile 28 is stretched by the airflow from the first outlet 20 being directed in different directions. The steam emitted from the second outlet 12 is emitted towards the textile 28 as it is being stretched by the airflow. Thus, wrinkles may be removed, at least to a large extent, from the textile 28.

A directing surface 30 extends in a direction from the textile contact surface 10 adjacent to the first outlet 20. A length of the directing surface 30 extending from the first outlet 20 may be 5 mm, but the length may be shorter or longer.

Figure 3A:
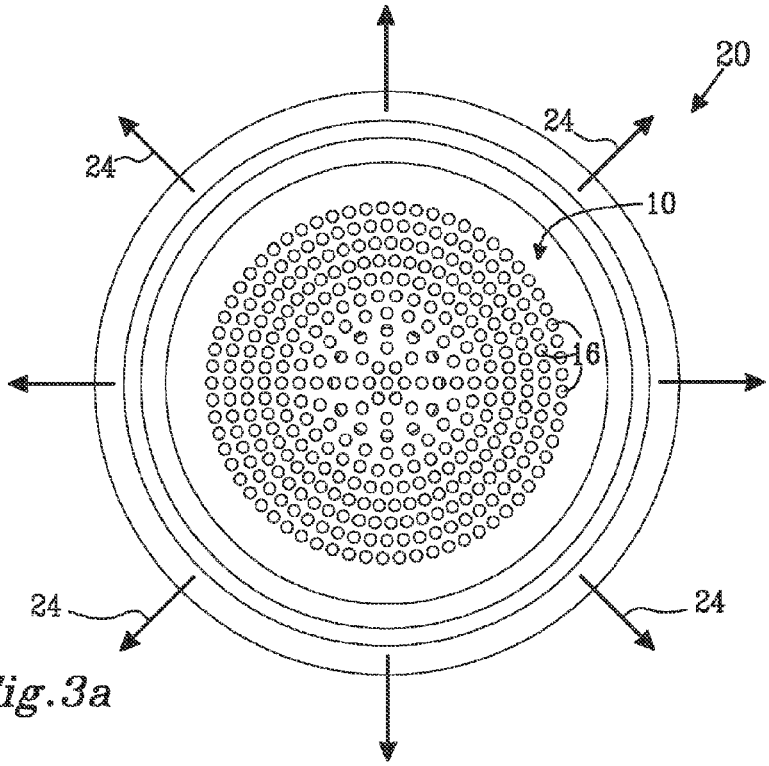
FIGS. 3*a*, 3*b*, and 3*c* illustrate different configurations of portions of appliances according to embodiments.
Figure 3B:
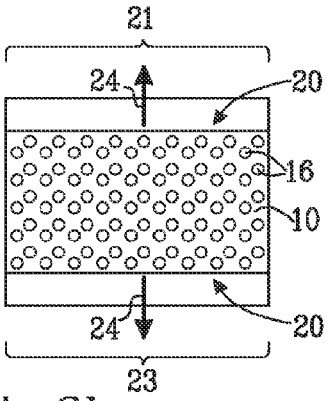
Figure 3C:
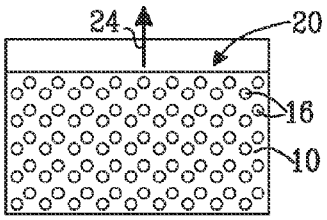

FIGS. 3*a*, 3*b*, and 3*c* illustrate different configurations of portions of appliances according to embodiments. A first outlet 20 is arranged adjacent to a textile contact surface 10. Openings 16 of a second outlet are arranged in the textile contact surface 10 and are arranged for emitting steam towards a textile to be treated. In use of the appliance, an airflow is directed from the first outlet 20 in an airflow direction 24 away from a normal of the textile contact surface 10.

In the FIG. 3*a* embodiments the first outlet 20 extends around the textile contact surface 10. The first outlet 20 may be divided into two or more passages. The textile contact surface 10 is substantially circular by may alternatively have a different shape, such as oval, elongated, square, or triangular.

In the FIG. 3*b* embodiments the first outlet 20 comprises a first passage 21 and a second passage 23. The textile contact surface 10 is arranged between the first passage 21 and the second passage 23. The airflow direction 24 is directed in two opposite directions away from the textile contact surface 10.

In the FIG. 3*c* embodiments the first outlet 20 is arranged adjacent one side only of the textile contact surface 10. In these embodiments, a textile to be treated is engaged by the airflow and stretched by the airflow while the portion of the appliance comprising the textile contact surface 10 and the first outlet 20 is either held still, or moved in a direction substantially opposite to the airflow direction 24.

Figure 4:
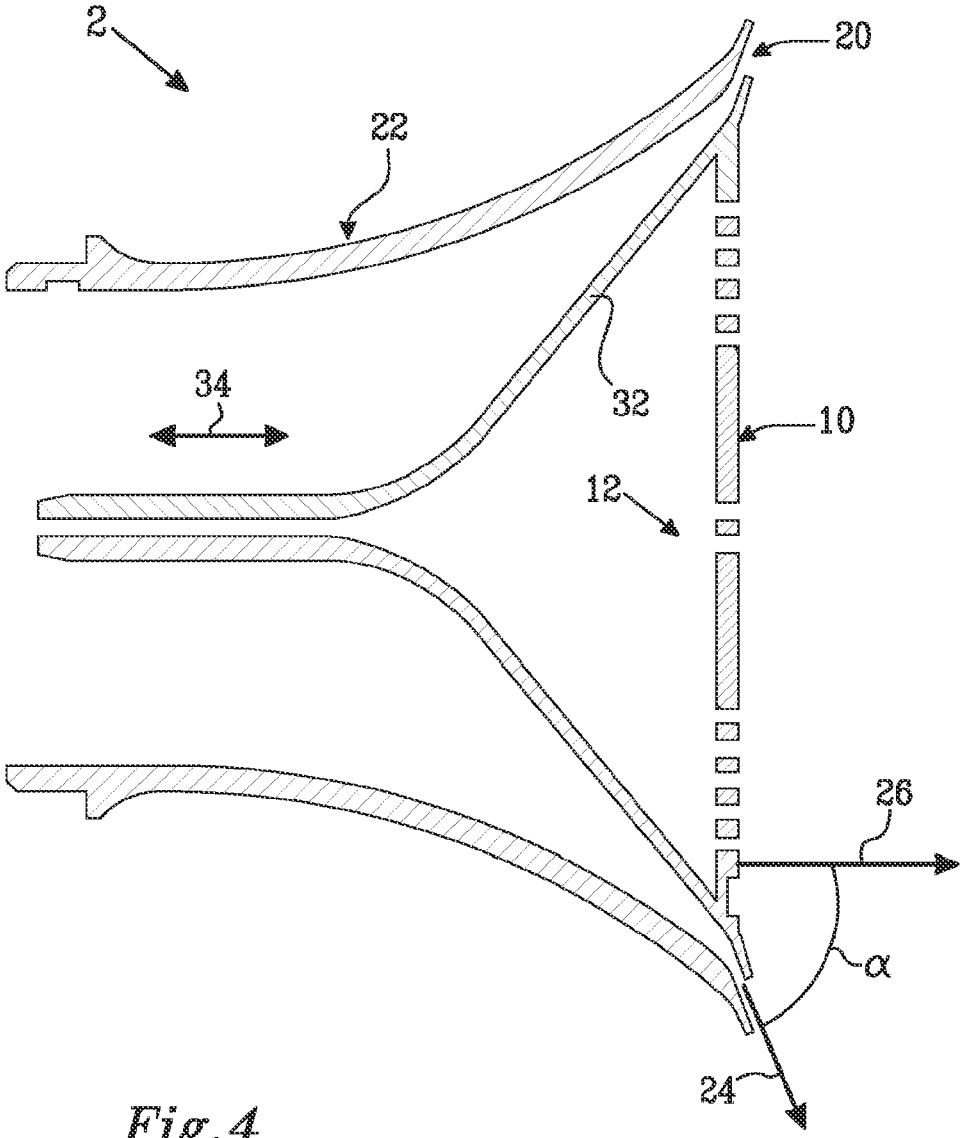
FIG. 4 illustrates a cross section of a portion of an appliance according to embodiments.

FIG. 4 illustrates a cross section of a portion of an appliance 2 according to embodiments. These embodiments resemble the FIG. 1 and FIG. 2 embodiments. The main differences will now be discussed.

The first outlet 20 is arranged to direct an airflow in an airflow direction 24 away from a normal 26 of the textile contact surface 10. The airflow direction 24 forms an angle a of somewhere between 70 and 85 degrees to the normal 26 of the textile contact surface 10.

A funnel forming portion 32 comprising the second outlet 12 is movably arranged in the first conduit 22, as indicated by arrows 34. Thus, a cross section of the first outlet 20 is adjustable in size. The funnel forming portion 32 may be movable to such an extent that the first outlet 20 may be closed. A user of the appliance may move the funnel forming portion 32, e.g. by means of a non-shown handle. Conversely, a portion of the first conduit 22 surrounding the funnel forming portion 32 at the first outlet 20 may be movably arranged in relation to the funnel forming portion 32 to adjust a size of the first outlet 20.

Figure 5:
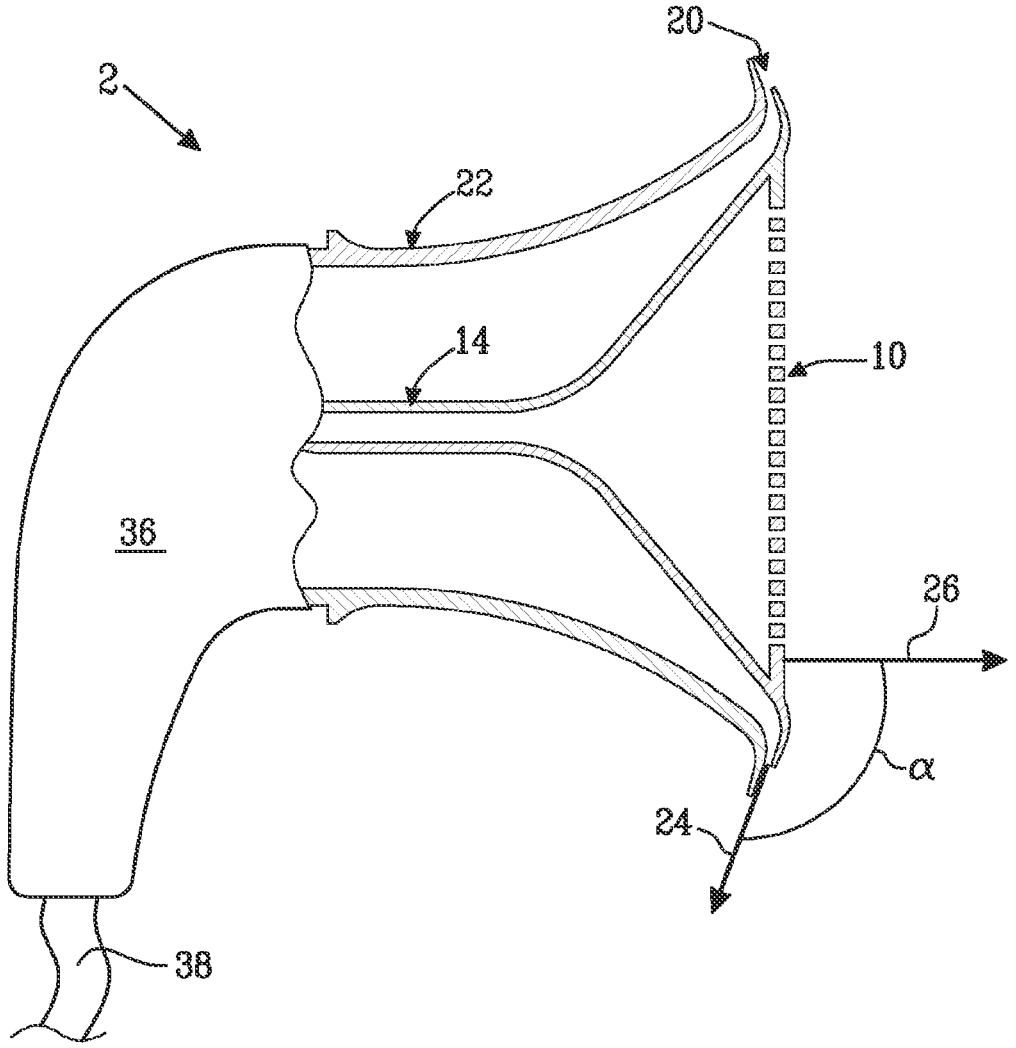
FIG. 5 illustrates a partial cross section of a portion of an appliance according to embodiments.

FIG. 5 illustrates a partial cross section of a portion of an appliance 2 according to embodiments. These embodiments resemble the FIG. 1 and FIG. 2 embodiments. The main differences will now be discussed.

The first outlet 20 is arranged to direct an airflow in an airflow direction 24 away from a normal 26 of the textile contact surface 10. The airflow direction 24 forms an angle a of somewhere between 105 and 120 degrees to the normal 26 of the textile contact surface 10.

The textile contact surface 10, the second outlet 12, and the first outlet 20 are arranged in a handle 36. The handle 36 is manually manoeuvrable such that a user may hold the handle 36 and direct it along a textile to be treated. The first and first conduits 14, 22 extend through a flexible hose 38. The hose 38 leads to a unit of the appliance 2 comprising the steam producing unit and the airflow generating device.

In FIGS. 4 and 5, airflow directions 24 at an outer end of a suitable interval of airflow directions 24 have been illustrated. Accordingly, the airflow direction 24 may be directed at any angle a between 70 and 120 degrees to a normal 26 of the textile contact surface 10, or at any angle a between 85 and 105 degrees to a normal 26 of the textile contact surface 10.

Figure 6:
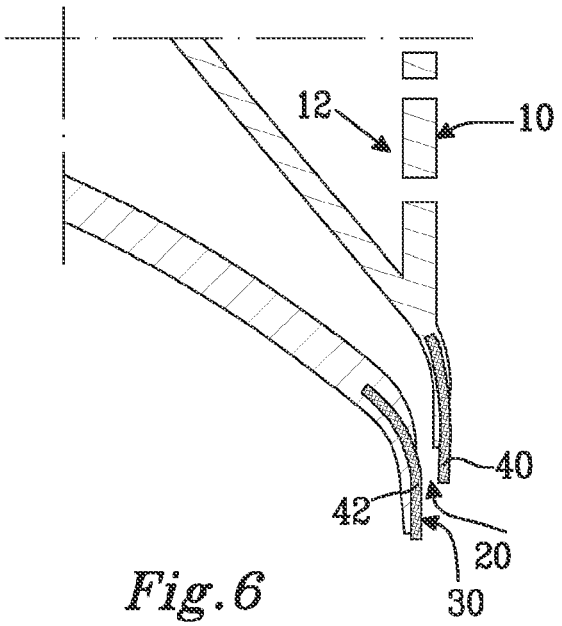
FIG. 6 illustrates a cross section of an outer portion of a first and a first outlet of an appliance according to embodiments.

FIG. 6 illustrates a cross section of an outer portion of a first and a first outlet 12, 20 of an appliance according to embodiments. These embodiments resemble the above discussed embodiments. The main difference lies in that the first outlet 20 comprises at least one flexible edge portion 40, 42. A size of the first outlet 20 may thus be automatically adjusted. A first flexible edge portion 40 is arranged as an extension of the textile contact surface 10. A second flexible edge portion 42 is arranged at the directing surface 30, the directing surface 30 being arranged adjacent to the first outlet 20 extending in a direction away from the textile contact surface 10. The first and second flexible edge portions 40, 42 may suitably extend along the entire first outlet 20. The first and second flexible edge portions 40, 42 may be manufactured from any suitable flexible material such as rubber or a thermoplastic elastomer. Alternatively, the first outlet 20 may be provided with only one of the first or the second flexible edge portions 40, 42.

Figure 7:
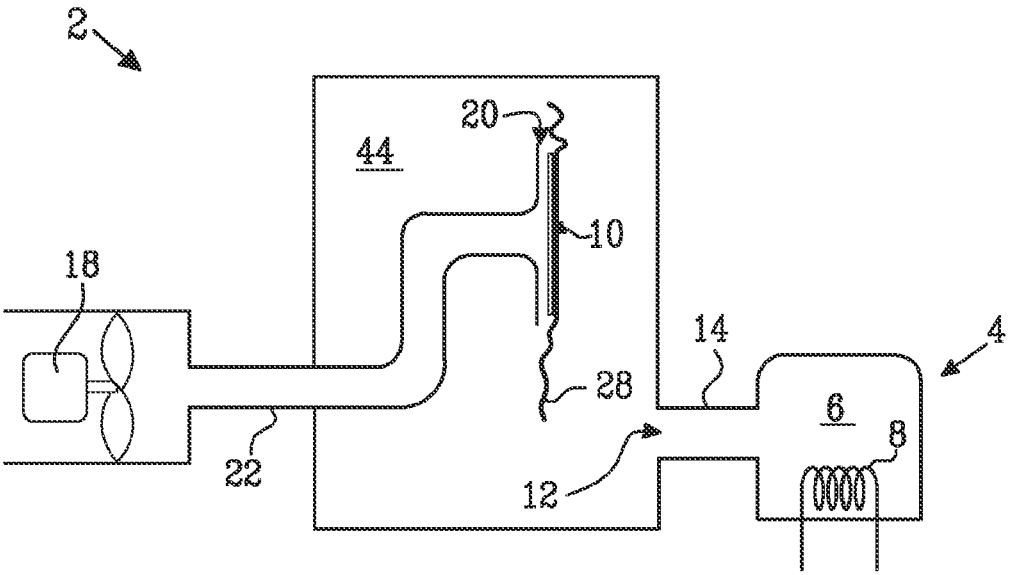
FIG. 7 illustrates schematically an appliance according to embodiments.

FIG. 7 illustrates schematically an appliance 2 according to embodiments. The appliance 2 may be used for treating a textile, such as a garment, in particular to remove wrinkles from the textile. The appliance 2 comprises a directing arrangement comprising an enclosure 44 inside which a textile 28 to be treated may be placed.

The appliance 2 comprises a steam producing unit 4 for producing steam from water. The steam producing unit 4 comprises a container 6 and a heating element 8 for heating water in the container 6. A second outlet 12, arranged in the enclosure 44, is connected to the steam producing unit 4 via a second conduit 14. Accordingly, the second conduit 14 extends from the steam producing unit 4 to the second outlet 12. Thus, steam produced in the steam producing unit 4 may be supplied into the enclosure and onto the textile 28.

An airflow generating device 18 is connected to a first outlet 20 via a first conduit 22. Accordingly, the first conduit 22 extends from the airflow generating device 18 to the first outlet 20. The first outlet 20 is arranged adjacent to a textile contact surface 10 as discussed in connection with FIG. 1*a* and the first outlet 20 is arranged to direct an airflow from the airflow generating device 18 in an airflow direction, again as discussed above in connection with FIG. 1*a*. The airflow direction is directed away from a normal of the textile contact surface 10.

Movement of the textile contact surface 10 and the first outlet 20 along the textile 28 may be performed automatically by a non-shown automatically controlled manipulator, or by a user via a non-shown manual manipulator, or by a user via non-shown gloves extending from walls of the enclosure 44 into the enclosure 44 (as in a sand blasting cabinet).

Figure 8:
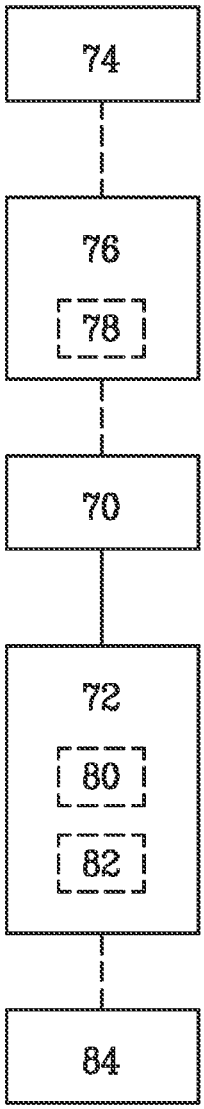
FIG. 8 illustrates a method of treating a textile.

FIG. 8 illustrates a method of treating a textile. The method comprises: producing 70 an airflow, directing 72 the airflow through a first outlet arranged adjacent to a textile contact surface in an airflow direction directed away from a normal of the textile contact surface, for making the textile interact with the textile contact surface.

According to embodiments, the method may further comprise: producing 74 steam from water, and directing 76 the steam produced towards the textile.

According to embodiments, the said directing 76 the steam may comprise: emitting 78 the steam produced from a second outlet arranged in connection with the textile contact surface.

According to embodiments, the said directing 72 the airflow may comprise: directing 80 the airflow direction to form one angle of 70-120 degrees to the normal of the textile contact surface.

According to embodiments, the said directing 72 the airflow may comprise: directing 82 the airflow direction to form an angle of 85-105 degrees to the normal of the textile contact surface.

According to embodiments, the method may comprise: adjusting 84 a size of a cross section of the first outlet.

Example embodiments described above may be combined as understood by a person skilled in the art. It is also understood by those skilled in the art that the appliance 2 may be a handheld device comprising at least the steam producing unit 4, the textile contact surface 10, the second outlet 12, the airflow generating device 18, and the first outlet 20. Alternatively, the steam producing unit 4 and/or the air flow generating device 18 may be separate from the handheld device. Alternatively, the appliance 2 may comprise a handle 36 as illustrated in FIG. 5 with the steam producing unit 4 and the airflow generating device 18 arranged in a movable unit, which may be carried or provided with wheels. A further alternative may be that the appliance 2 comprises a handle 36 as illustrated in FIG. 5 and the steam producing unit 4 and the airflow generating device 18 are arranged in a stationary unit to be installed e.g. in a laundry room.

Although the invention has been described with reference to example embodiments, many different alterations, modifications and the like will become apparent for those skilled in the art. The appliance may be used for treating a relevant textile after the textile has been treated with steam in a preceding steam treatment step. Additives such as detergent or perfume may be used in the water from which steam is produced in the steam producing unit. Airflow and steam may for instance be mixed. This may be arranged in different ways. An amount of steam is led from the steam producing unit 4 into the airflow, e.g. in the first conduit 22 or at the first outlet 20. Conversely, part of the airflow from the airflow generating device 18 may be led into the steam, e.g. in the second conduit 14 or at the second outlet 12. It also may be forint to lead both air and steam into the steam and the airflow. In embodiments where air and steam are mixed the invention still is based on the use a first outlet for an airflow which engages with the textile. The appliance may be used for treating a relevant textile after the textile has been treated with steam.

The textile contact surface 10 may have a curved shape. A length of the directing surface 30 may be variable. The textile contact surface 10 may be smooth or rough (without sharp edges or protrusions).

Therefore, it is to be understood that the foregoing is illustrative of various example embodiments and that the invention is defined only the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A method of treating a textile, the method comprising:

providing an appliance having a textile contact surface, one or more steam outlet openings through the textile contact surface, a first lip located at an edge of the textile contact surface, a second lip that is spaced from the first lip to form an airflow outlet between the first lip and the second lip;

producing an airflow;

directing the airflow through the airflow outlet and along the textile to be treated;

generating a force, via interaction between the airflow and the textile, to move the textile towards the textile contact surface;

producing steam from water; and directing the steam through the one or more steam outlet openings towards the textile.

2. The method according to claim 1, wherein directing the airflow through the airflow outlet comprises:

directing the airflow direction at an angle of 70-120 degrees to a normal of the textile contact surface.

3. The method according to claim 1, wherein directing the airflow through the airflow outlet comprises:

directing the airflow direction at an angle of 85-105 degrees to a normal of the textile contact surface.

4. The method according to claim 1, further comprising:

adjusting a size of a cross section of the airflow outlet.

5. An appliance for treating a textile, the appliance comprising:

a textile contact surface;

a steam outlet comprising one or more openings through the textile contact surface;

a steam generator configured to generate a flow of steam through the steam outlet;

an airflow outlet positioned between a first lip that surrounds the textile contact surface and a second lip that is spaced from the first lip; and an airflow generating device configured to generate an airflow through the airflow outlet;

wherein the airflow outlet is configured to direct the airflow in an airflow direction that is oriented at an angle of 70-120 degrees relative to a normal of the textile contact surface.

6. An appliance for treating a textile, the appliance comprising:

a textile contact surface having one or more steam outlet openings passing therethrough;

a steam producing device;

a steam conduit connecting the steam producing device to the one or more steam outlet openings;

a first lip located at an edge of the textile contact surface;

a second lip spaced from the first lip;

an airflow outlet defined by a first surface of the first lip and a second surface of the second lip, the second surface facing and being spaced from the first surface;

an airflow generating device; and an airflow passage connecting the airflow generating device to the airflow outlet;

wherein the first surface and the second surface are oriented to direct an airflow received from the airflow generating device away from the textile contact surface at an angle of 70-120 degrees from a normal of the textile contact surface.

7. The appliance according to claim 6, wherein the angle is 105-120 degrees to a normal of the textile contact surface.

8. The appliance according to claim 6, wherein the first surface is movable relative to the second surface such that the airflow outlet is adjustable in size.

9. The appliance according to claim 6, wherein the airflow outlet extends around the textile contact surface.

10. The appliance according to claim 6, wherein at least one of the first lip and the second lip comprises a flexible edge portion.

11. The appliance according to claim 6, wherein the angle is 70-85 degrees to a normal of the textile contact surface.

12. The appliance according to claim 6, wherein the angle is 85-105 degrees to a normal of the textile contact surface.

13. The appliance according to claim 6, wherein the airflow outlet comprises a first passage and a second passage, and wherein the textile contact surface is arranged between the first passage and the second passage.

14. The appliance according to claim 9, wherein the textile contact surface and the airflow outlet are circular as viewed along a normal to the textile contact surface.

15. The appliance according to claim 6, further comprising a directing surface that extends from the second surface in a direction away from the textile contact surface.

16. The appliance according to claim 5, wherein the textile contact surface, the steam outlet, and the airflow outlet are arranged in a manually maneuverable handle.

17. The appliance according to claim 5, wherein the first lip is movable relative to the second lip such that the airflow outlet is adjustable in size.

* * * * *